US010125954B1

(12) United States Patent
Zhang et al.

(10) Patent No.: US 10,125,954 B1
(45) Date of Patent: Nov. 13, 2018

(54) OUTDOOR PROJECTOR LIGHT PROJECTING FOLDABLE UMBRELLA PATTERNS WITH A FLUTTERING EFFECT

(71) Applicant: GEMMY INDUSTRIES CORPORATION, Coppell, TX (US)

(72) Inventors: Cheng-Chun Zhang, Shenzhen (CN); Lio Yenwei Chang, Coppell, TX (US)

(73) Assignee: GEMMY INDUSTRIES CORPORATION, Coppell, TX (US)

( * ) Notice: Subject to any disclaimer, the term of this patent is extended or adjusted under 35 U.S.C. 154(b) by 0 days.

(21) Appl. No.: 15/821,576

(22) Filed: Nov. 22, 2017

(51) Int. Cl.

| | |
|---|---|
| ***F21V 11/00*** | (2015.01) |
| ***F21V 14/06*** | (2006.01) |
| ***F21V 5/04*** | (2006.01) |
| ***F21S 6/00*** | (2006.01) |
| ***F21V 21/08*** | (2006.01) |
| ***F21V 21/22*** | (2006.01) |
| ***F21V 23/00*** | (2015.01) |
| ***F21V 23/02*** | (2006.01) |
| ***F21V 21/26*** | (2006.01) |
| *F21W 131/10* | (2006.01) |

(52) U.S. Cl.
CPC ..... *F21V 14/06* (2013.01); *F21S 6/005* (2013.01); *F21V 5/04* (2013.01); *F21V 5/048* (2013.01); *F21V 21/0824* (2013.01); *F21V 21/22* (2013.01); *F21V 21/26* (2013.01); *F21V 23/001* (2013.01); *F21V 23/02* (2013.01); *F21W 2131/10* (2013.01)

(58) Field of Classification Search
CPC ..... F21V 5/04; F21V 13/04; F21V 7/0008; F21V 29/74
USPC ..... 362/235
See application file for complete search history.

(56) References Cited

U.S. PATENT DOCUMENTS

2016/0123546 A1* 5/2016 Hu ..... F21V 21/30 362/235
2016/0147135 A1* 5/2016 Cheng ..... G03B 21/204 353/31

* cited by examiner

*Primary Examiner* — Jamara Franklin
(74) *Attorney, Agent, or Firm* — Ming Chow; Sinorica, LLC

(57) ABSTRACT

An outdoor projector light includes an enclosure, a projection device and a rotation device mounted inside the enclosure. A support device is connected with the enclosure. A primary lighting unit and a secondary lighting unit with multiple secondary lamps thereon are mounted on the support frame. The rotation device has a motor, a gear-pressing plate, a rotation base and a lens-mounting disc with multiple lenses thereon. The rotation base is rotatably mounted to the projection device and abuts against the gear-pressing plate to ensure stable operation of the rotation base. The lens-mounting disc is mounted on the rotation base. The lenses are even multiples of the secondary lamps in number. When the rotation device rotates the lens-mounting disc, light emitted from the secondary lighting unit passes through the lenses to project an even number of patterns simulating open and closed states of an umbrella with variation of dynamic pattern movement.

20 Claims, 9 Drawing Sheets

OUTDOOR PROJECTOR LIGHT PROJECTING FOLDABLE UMBRELLA PATTERNS WITH A FLUTTERING EFFECT

BACKGROUND OF THE INVENTION

1. Field of the Invention

The present invention relates to an outdoor projector light and, more particularly, to an outdoor projector light projecting foldable umbrella patterns with a fluttering effect.

2. Description of the Related Art

To entertain spectators and create a lively atmosphere, current stage lighting already meets the lighting effect with dynamic images and static patterns alternately switched. Given a conventional projector light projecting patterns with a fluttering effect as an example, the conventional projector light includes a power board, a motor, a rotary board, multiple lenses, a lighting assembly and a film with patterns, which are mounted inside a lamp housing. The power board is electrically connected to the motor. The motor has a spindle driven by the motor to rotate. The rotary board is rotatably mounted inside the lamp housing and is driven by the spindle. The multiple lenses are mounted on the rotary board, are located around the rotary board, and are spaced apart from each other. The lighting assembly is mounted behind the film and the multiple lenses. When the motor drives the spindle to rotate, the rotary board is driven by the spindle to rotate and the multiple lenses are rotated with the rotary board, such that the projected patterns are drifted with locations of the multiple lenses in rotation to exhibit a fluttering light effect.

However, when the motor of the conventional projector light drives the spindle to rotate and the rotary board is rotated as well, the rotary board is vibrated. Such vibration causes shaking movement of the projected patterns and results in instability in pattern projection. Thus, a disorderly and chaotic viewing effect to spectators may arise from the fluttering patterns observed to move in a random manner.

SUMMARY OF THE INVENTION

An objective of the present invention is to provide an outdoor projector light projecting foldable patterns with a fluttering effect by projecting patterns in an orderly and fluttering fashion.

To achieve the foregoing objective, the outdoor projector light includes an enclosure, a projection device, a rotation device and a support device.

The enclosure has a body, a lid and a cable connection seat.

The body has a chamber, an opening and a cable hole.

The chamber is defined inside the body.

The opening is formed through a front portion of the body and communicates with the chamber.

The cable hole is formed through a rear portion of the body and communicates with the chamber.

The lid is mounted on the body to cover the opening.

The cable connection seat is mounted in the body, is located inside the chamber, and is adjacent to the cable hole.

The projection device is mounted inside the chamber of the enclosure and has a support frame, a primary lighting unit and a secondary lighting unit.

The support frame is mounted on an inner wall of the enclosure and is located inside the chamber.

The primary lighting unit is mounted in the support frame and has a primary lamp, a primary film and a lens assembly.

The primary lamp is centrally mounted in the support frame.

The primary film is mounted on the support frame, is located in front of the primary lamp, and has multiple background patterns.

The lens assembly is mounted in the support frame and is located in front of the primary film.

The secondary lighting unit is mounted on the support frame, is located around the primary lighting unit, and has a secondary light board and multiple secondary lamps.

The secondary light board is circumferentially mounted on the support frame.

The multiple secondary lamps are mounted on the secondary light board, and are located around a center of a circle formed by the multiple secondary lamps. The center of the circle is located at the primary lamp.

The rotation device is located inside the chamber and has a power board, a motor, a driving gear, a gear-pressing plate, a rotation base, a lens-mounting disc and multiple bi-convex lenses.

The power board is mounted inside the enclosure and is electrically connected to the projection device.

The motor is mounted on the support frame, is electrically connected to the power board, and has a spindle rotatably mounted therein.

The driving gear is mounted on a free end of the spindle and is rotated with the spindle.

The gear-pressing plate is mounted on the support frame.

The rotation base is rotatably mounted to the projection device, abuts against the gear-pressing plate, and has a driven gear and a bushing.

The driven gear is formed around a periphery of the rotation base and engages the driving gear.

The bushing is rotatably mounted inside the support frame of the projection device and abuts against an inner wall of the rotation base.

The lens-mounting disc is securely mounted on a front portion of the rotation base.

The multiple bi-convex lenses are mounted on and located around the lens-mounting disc and are spaced apart from each other. The multiple bi-convex lenses are even multiples of the multiple secondary lamps of the projection device.

The support device is mounted on a bottom portion of the enclosure.

The outdoor projector light has the advantages that when the rotation device continuously rotates the bi-convex lenses on the lens-mounting disc, light emitted from the secondary lighting unit of the projection device passes through the continuously rotated bi-convex lenses to project the patterns of the secondary film with shapes similar to an umbrella gradually changing between a diverging position with the umbrella open and a converging position with the umbrella closed, such that an even number of umbrella-shaped patterns of the secondary film exhibit a fluttering viewing effect changing between the open and closed states on a clear background pattern. The fluttering patterns also give rise to an entertaining effect with variations of dynamic pattern movement. Besides, the fluttering patterns are projected in an orderly fashion instead of a random fashion for assurance of viewing comfort. Also because the rotation base abuts against the gear-pressing plate, the gear-pressing plate can prevent the rotation base from being vibrated when the rotation base is operated. Thus, the lens-mounting disc of the rotation base can be rotated in a more stable way.

Other objectives, advantages and novel features of the invention will become more apparent from the following detailed description when taken in conjunction with the accompanying drawings.

DETAILED DESCRIPTION OF THE INVENTION

Figure 1:
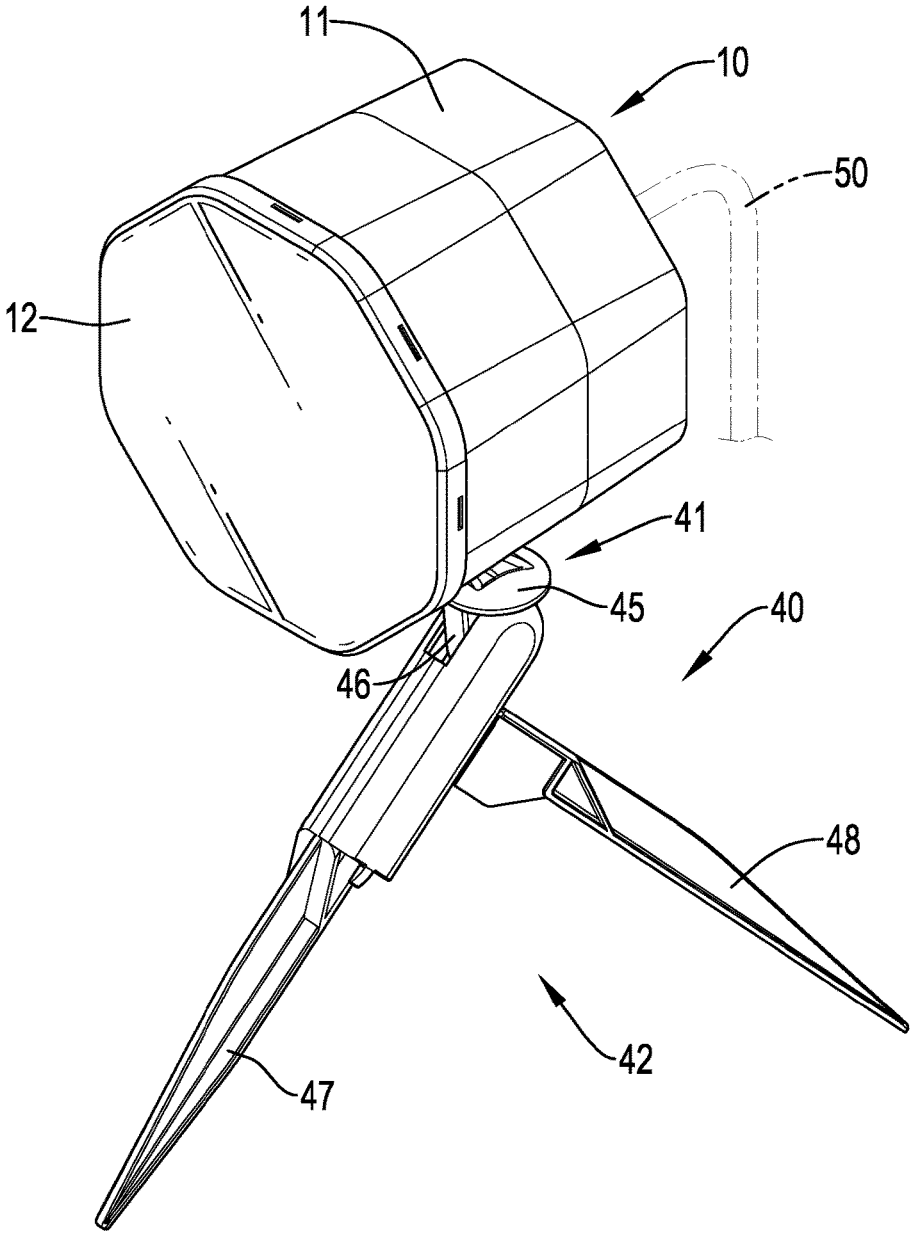
FIG. 1 is a perspective view of an outdoor projector light projecting foldable umbrella patterns with a fluttering effect in accordance with the present invention.
Figure 2:
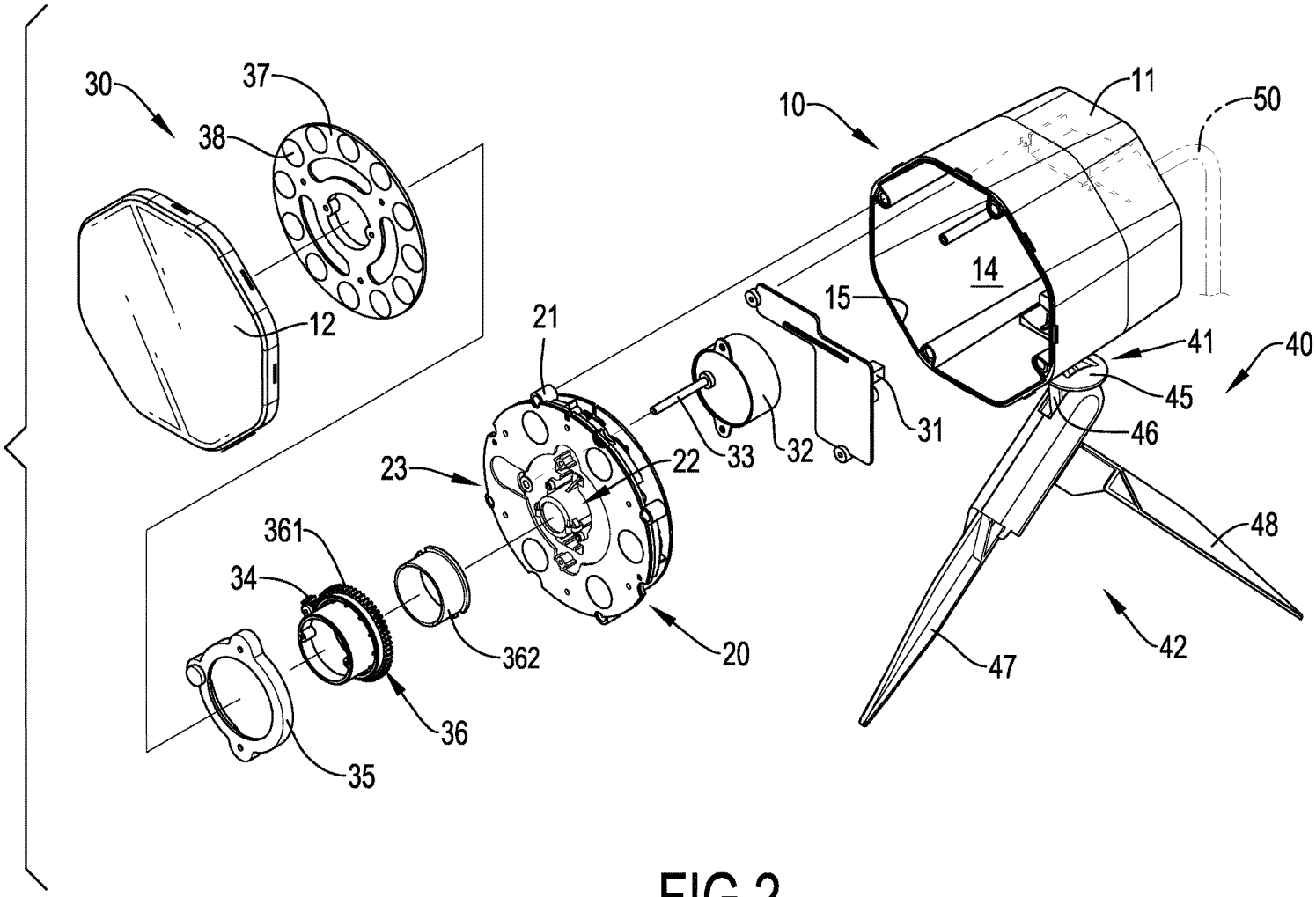
FIG. 2 is a partially exploded perspective view of the outdoor projector light in FIG. 1.

With reference to FIGS. 1 and 2, an outdoor projector light projecting foldable umbrella patterns with a fluttering effect in accordance with the present invention includes an enclosure 10, a projection device 20, a rotation device 30 and a support device 40.

Figure 6:
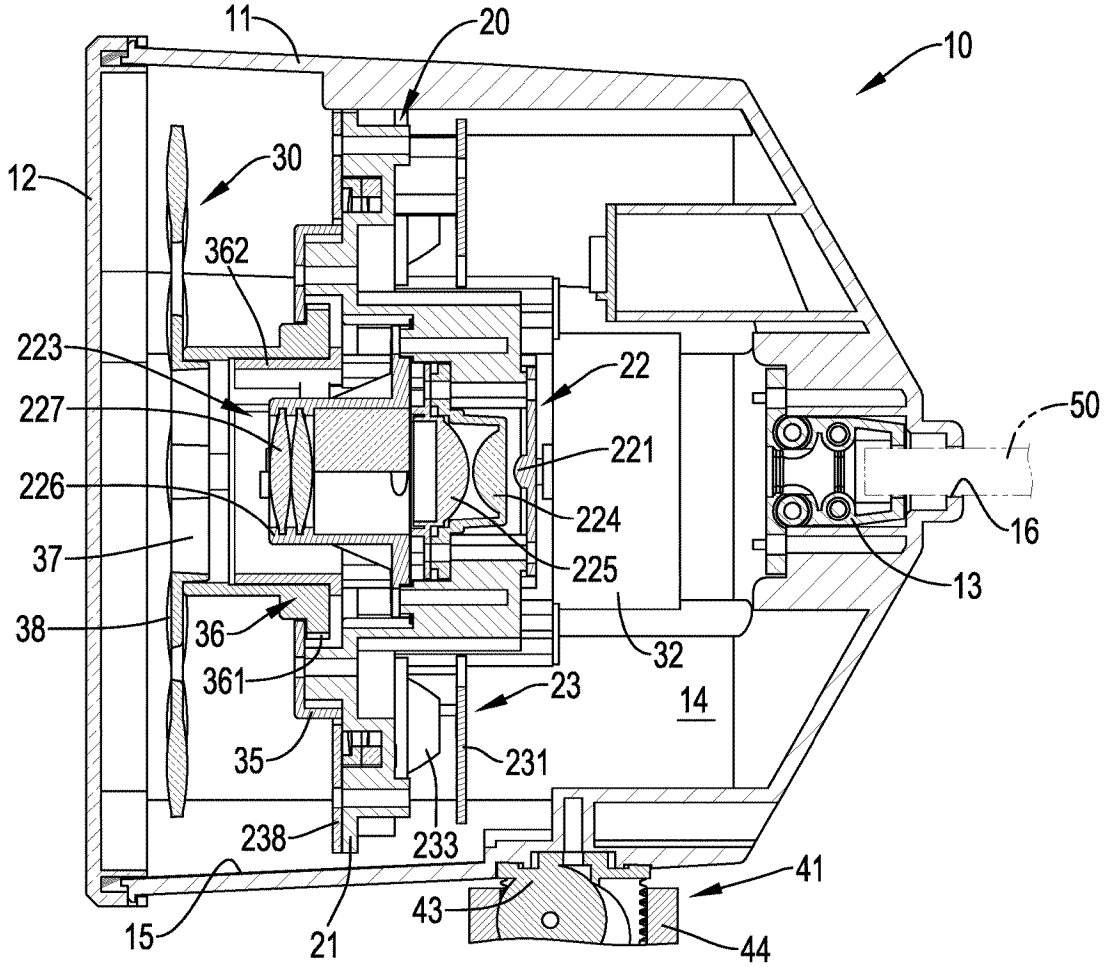
FIG. 6 is a side view in partial section of the outdoor projector light in FIG. 1.

With reference to FIGS. 1, 2 and 6, the enclosure 10 has a body 11, a lid 12 and a cable connection seat 13. The body 11 has a chamber 14, an opening 15 and a cable hole 16. The chamber 14 is defined inside the body 11. The opening 15 is formed through a front portion of the body 11 and communicates with the chamber 14. The cable hole 16 is formed through a rear portion of the body 11 and communicates with the chamber 14. The lid 12 is mounted on the body 11 to cover the opening 15. The cable connection seat 13 is mounted in the body 11, is located inside the chamber 14, and is adjacent to the cable hole 16.

Figure 3:
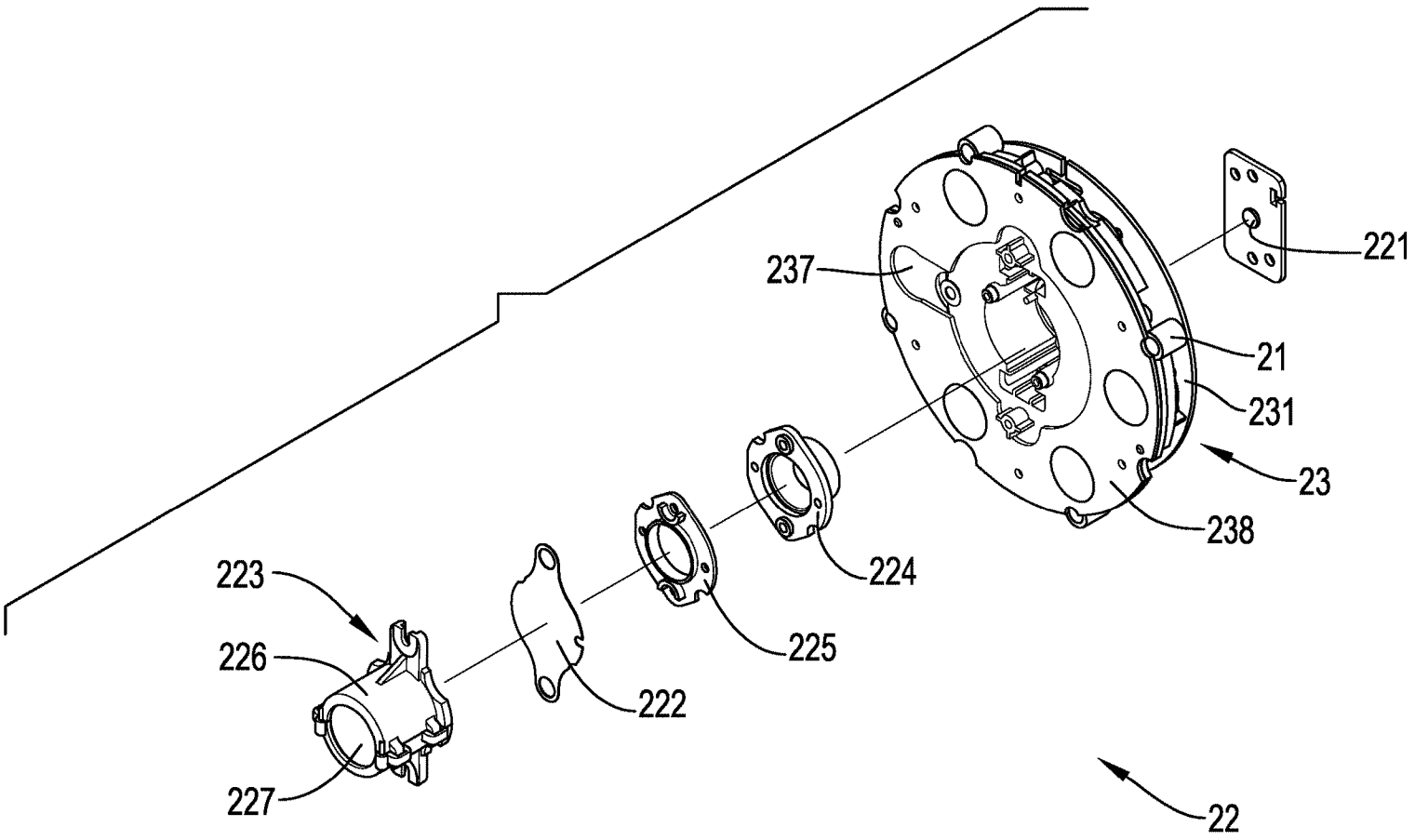
FIG. 3 is an enlarged exploded perspective view of the outdoor projector light in FIG. 2.
Figure 4:
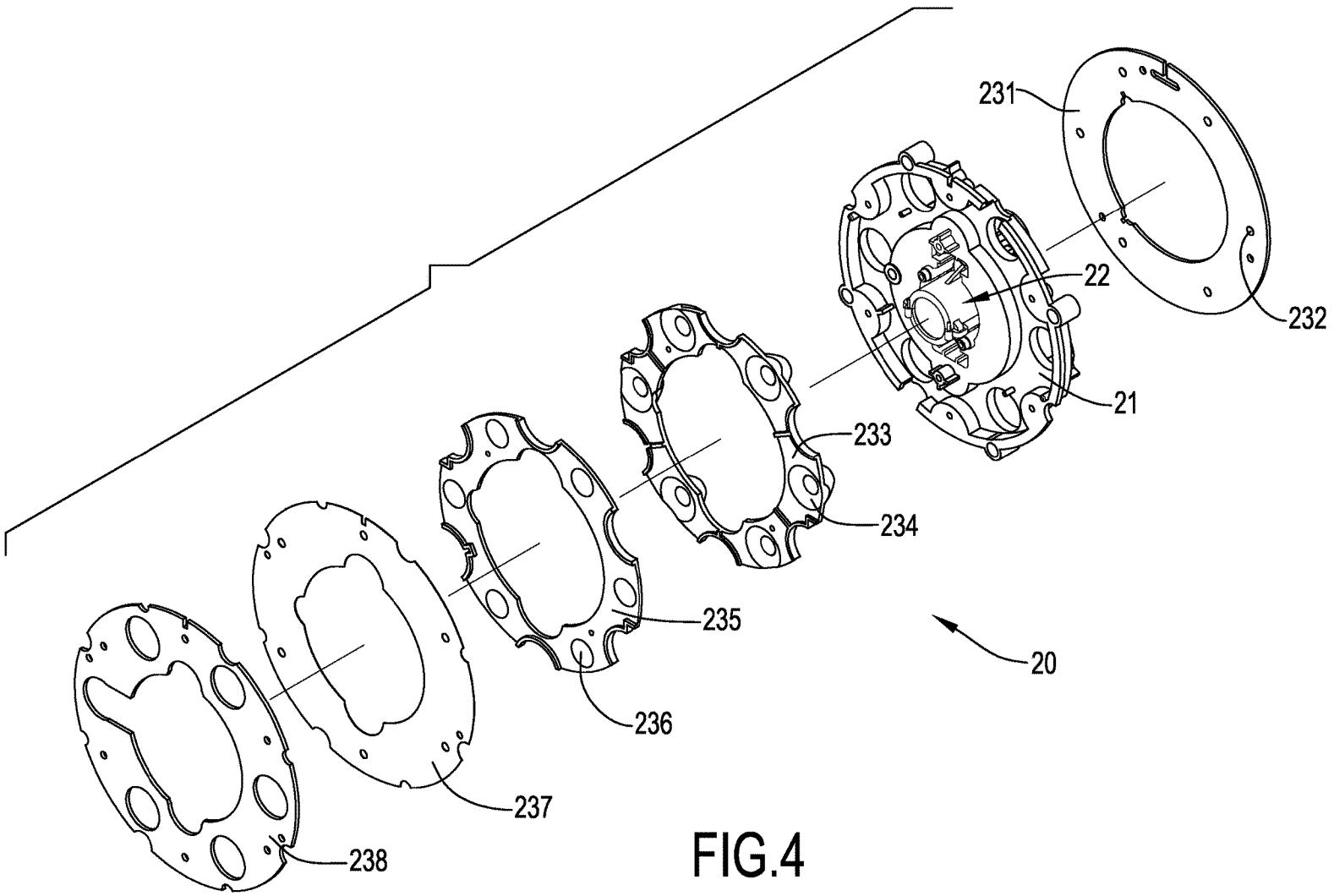
FIG. 4 is another enlarged exploded perspective view of the outdoor projector light in FIG. 2.

With reference to FIGS. 2 to 4, the projection device 20 is mounted inside the chamber 14 of the enclosure 10, and has a support frame 21, a primary lighting unit 22 and a secondary lighting unit 23. The support frame 21 is mounted on an inner wall of the enclosure 10 and is located inside the chamber 14. The primary lighting unit 22 is mounted in the support frame 21 and has a primary lamp 221, a primary film 222, and a lens assembly 223. The primary lamp 221 is centrally mounted in the support frame 21. The primary film 222 is mounted on the support frame 21 and is located in front of the primary lamp 221. The lens assembly 223 is mounted in the support frame 21 and is located in front of the primary film 222. The secondary lighting unit 23 is mounted on the support frame 21, is located around the primary lighting unit 22, and has a secondary light board 231 and multiple secondary lamps 232. The secondary light board 231 is circumferentially mounted on the support frame 21. The multiple secondary lamps 232 are mounted on the secondary light board 231 and are located around a center of a circle formed by the multiple secondary lamps 232, in which the center of the circle is located at the primary lamp 221.

The primary lighting unit 22 further has a first primary plano-convex lens 224 and a second primary plano-convex lens 225. The first primary plano-convex lens 224 is mounted inside the support frame 21 and is located in front of the primary lamp 221 with a planar side of the first primary plano-convex lens 224 facing the primary lamp 221. The second primary plano-convex lens 225 is mounted inside the support frame 21 and is located in front of the first primary plano-convex lens 224 with a convex side of the second primary plano-convex lens 225 facing the primary lamp 221. The lens assembly 223 has a lens seat 226 and two bi-convex lenses 227. The lens seat 226 is mounted in the support frame 21. The two bi-convex lenses 227 are mounted on the lens seat 226 and are spaced apart by a fixed distance. The secondary lighting unit 23 further has a lamp cup board 233, multiple lamp cups 234, a lens board 235, multiple secondary bi-convex lenses 236, a secondary film 237 and a film-pressing plate 238. The lamp cup board 233 is mounted on the support frame 21 and is located in front of the secondary light board 231. The multiple lamp cups 234 are formed on the lamp cup board 233 to correspond to the respective secondary lamps 232. The lens board 235 is mounted on a front side of the lamp cup board 233. The multiple secondary bi-convex lenses 236 are mounted on the lens board 235 to correspond to the respective lamp cups 234. The secondary film 237 is mounted on the lens board 235 to cover the multiple secondary bi-convex lenses 236 and has an even number of foreground patterns. The film-pressing plate 238 is mounted on the lamp cup board 233 to position and hold the secondary film 237 and the lens board 235 between the film-pressing plate 238 and the lamp cup board 233.

Figure 5:
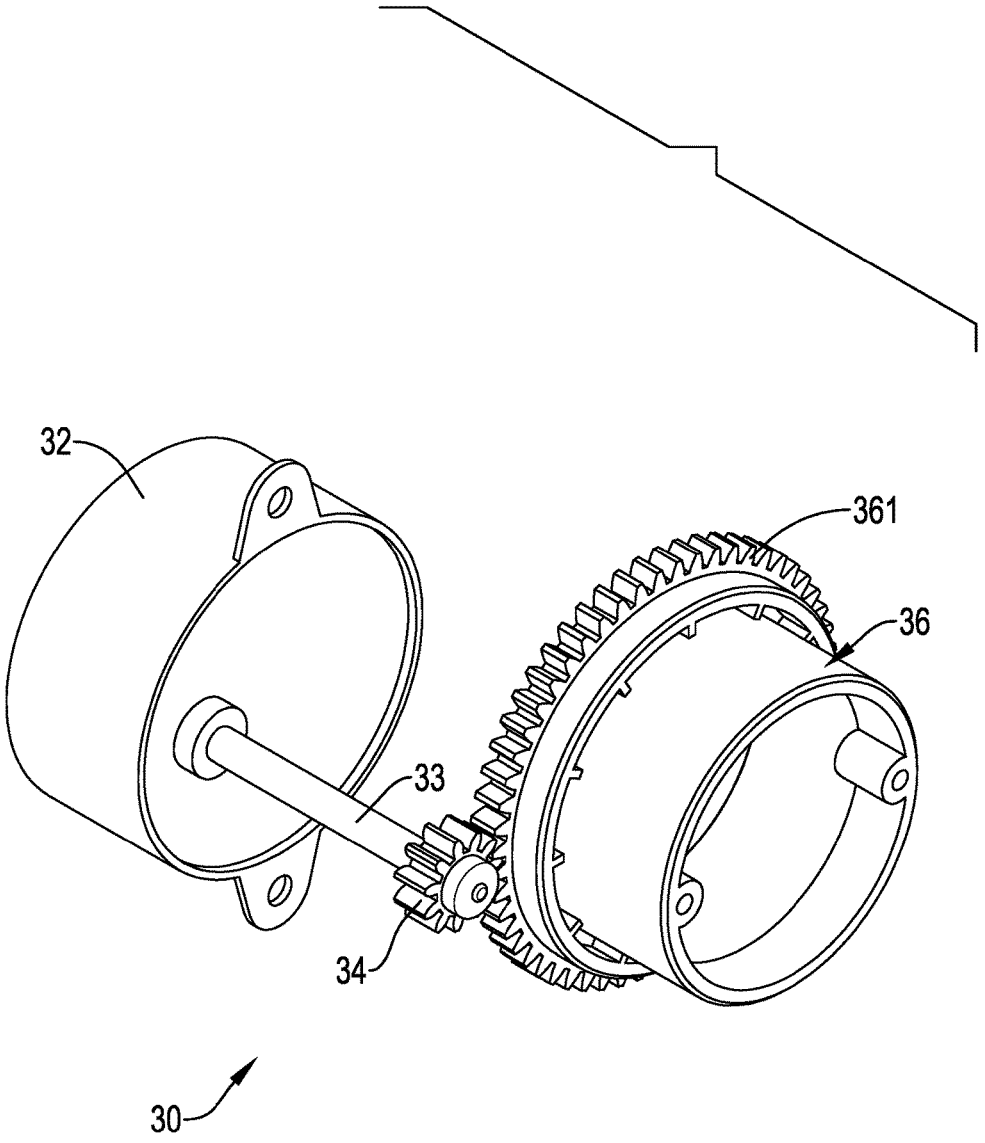
FIG. 5 is a perspective view of a rotation device of the outdoor projector light in FIG. 2.
Figure 7:
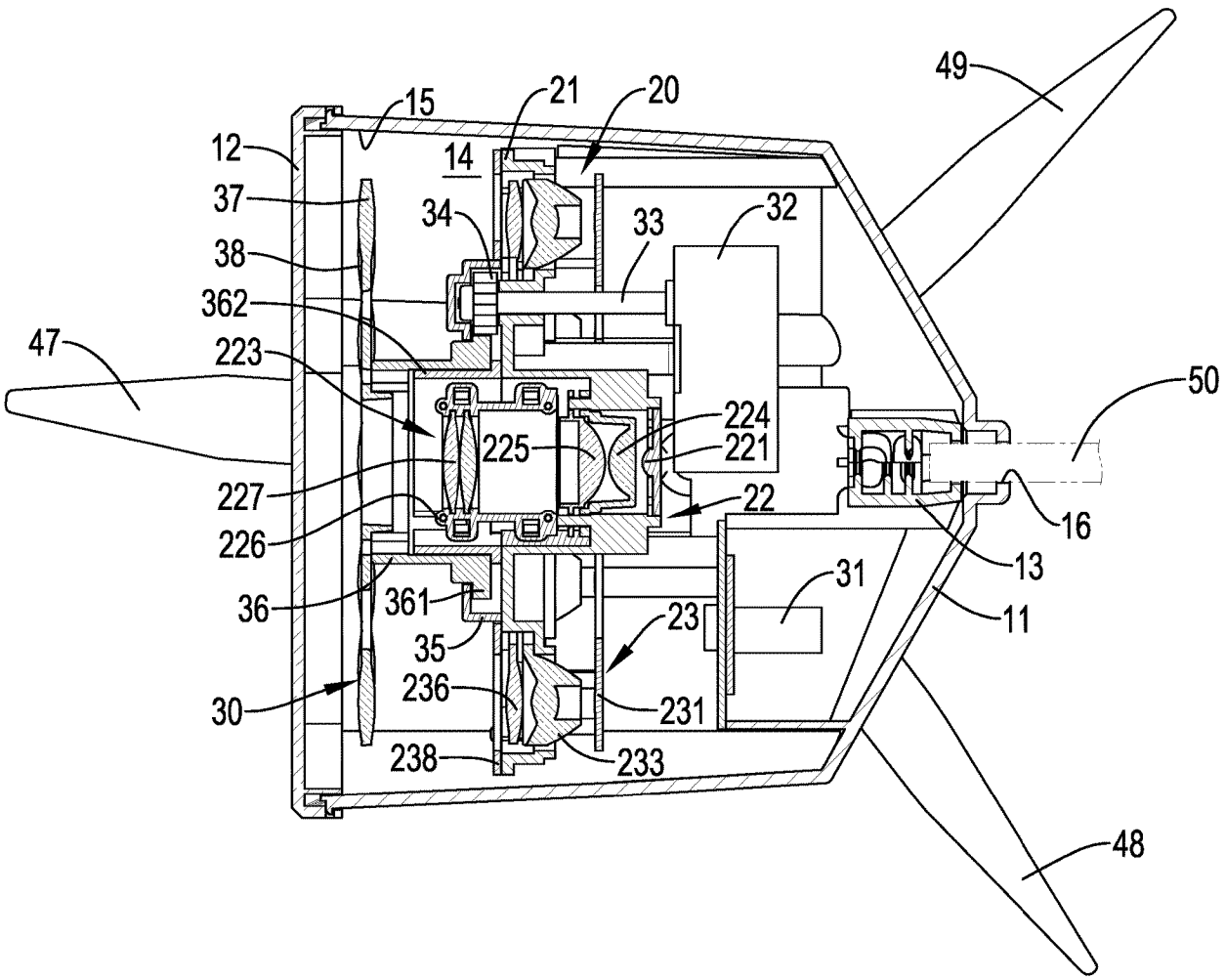
FIG. 7 is a top view in partial section of the outdoor projector light in FIG. 1.

With reference to FIGS. 2, 5 and 7, the rotation device 30 is located inside the chamber 14 and has a power board 31, a motor 32, a driving gear 34, a gear-pressing plate 35, a rotation base 36, a lens-mounting disc 37 and multiple bi-convex lenses 38. The power board 31 is mounted inside the enclosure 10 and is electrically connected to the projection device 20. The motor 32 is mounted on the support frame 21 of the projection device 20. The motor 32 is mounted on the support frame 21, is electrically connected to the power board 31, and has a spindle 33 rotatably mounted therein. The driving gear 34 is mounted on a free end of the spindle 33 and is rotated with the spindle 33. The gear-pressing plate 35 is mounted on the support frame 21. The rotation base 36 is centrally formed through, is rotatably mounted to the projection device 20, abuts against the gear-pressing plate 35, and has a driven gear 361 and a bushing 362. The driven gear 361 is formed around a periphery of the rotation base 36, engages the driving gear 34, and is driven by the driving gear 34. The bushing 362 is rotatably mounted inside the support frame 22 of the projection device 20 and abuts against an inner wall of the rotation base 36. The lens-mounting disc 37 is centrally formed through and is securely mounted on a front portion of the rotation base 36. The multiple bi-convex lenses 38 are mounted on and located around the lens-mounting disc 37, and are spaced apart from each other. The number of the multiple bi-convex lenses 38 is even multiples of the number of the multiple secondary lamps 232. In the present embodiment, the secondary lighting unit 23 has six secondary lamps 232, and the rotation device 30 has twelve bi-convex lenses 38.

Figure 8:
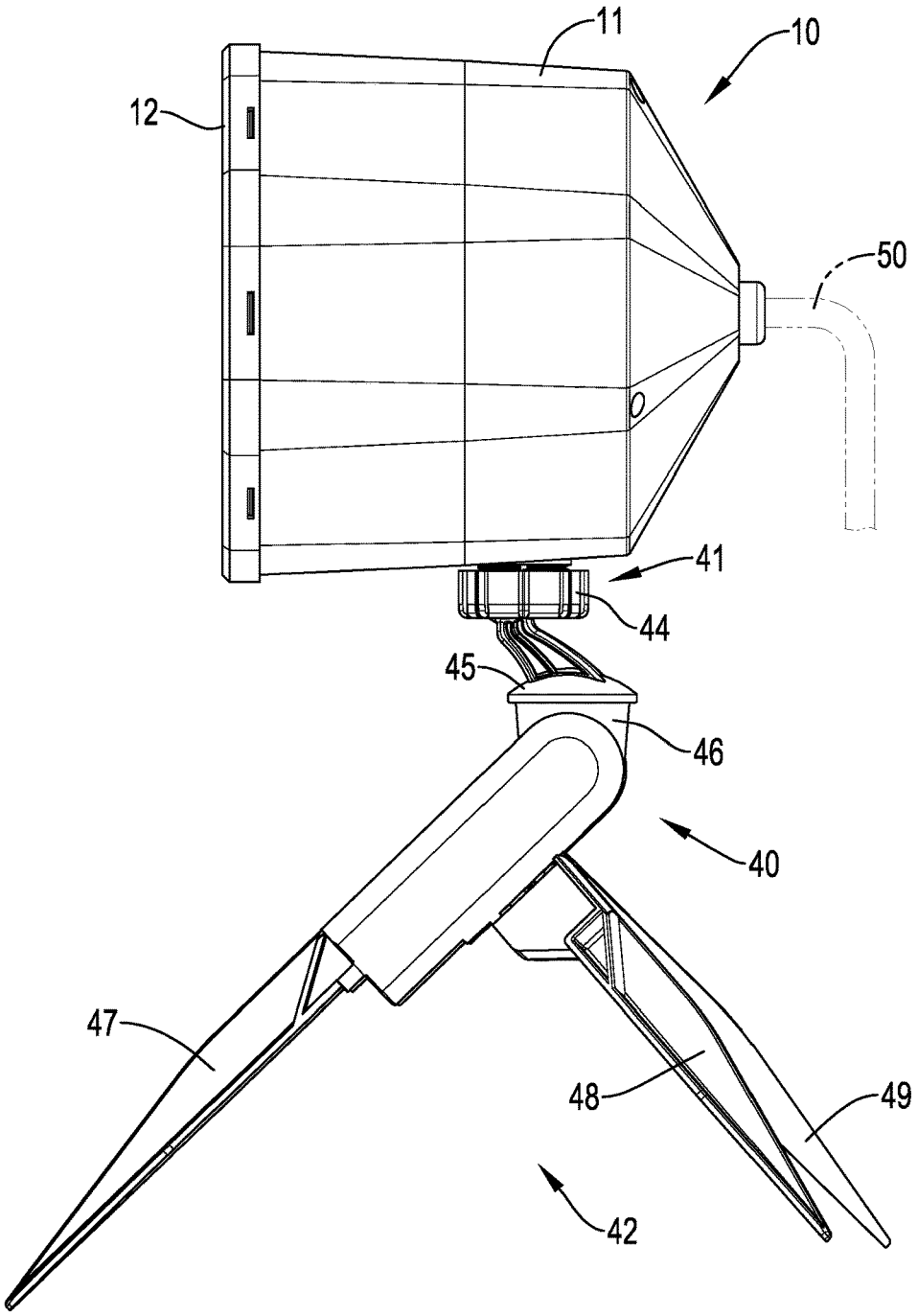
FIG. 8 is an operational side view of the outdoor projector light in FIG. 1.
Figure 9:
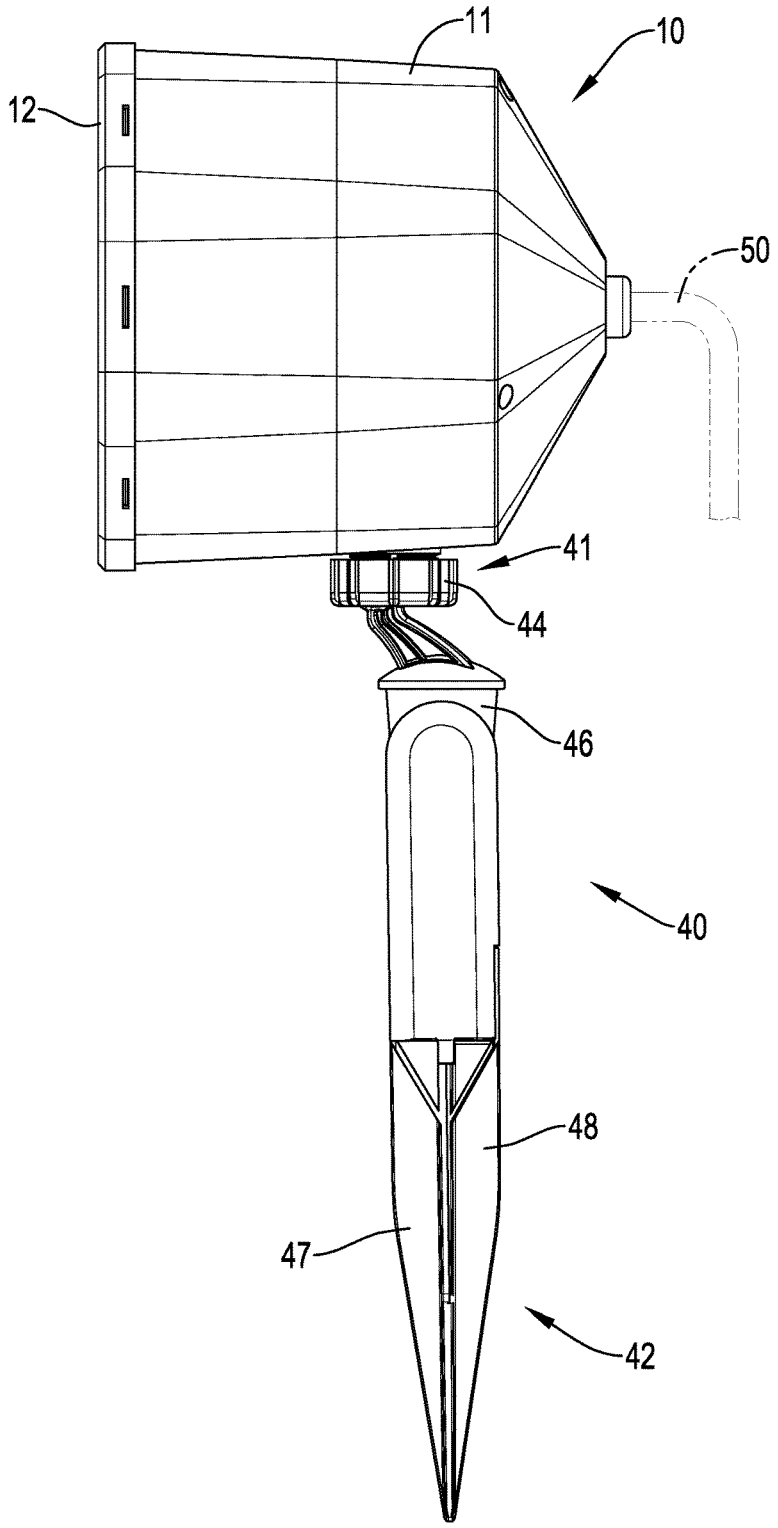
FIG. 9 is another operational side view of the outdoor projector light in FIG. 1.

With reference to FIGS. 6, 8 and 9, the support device 40 is mounted on a bottom portion of the enclosure 10 and has a connection assembly 41 and a foldable tripod 42. The connection assembly 41 is connected between the enclosure 10 and the foldable tripod 42 and has a connection seat 43, a connection ring 44 and a ball socket 45. The connection seat 43 is mounted on the bottom portion of the enclosure 10. The connection ring 44 is mounted around a periphery of the connection seat 43. The ball socket 45 is mounted in the connection seat 43. The foldable tripod 42 has an assembling member 46, a front leg 47 and two rear legs 48, 49. The assembling member 46 is connected with the ball socket 45. The front leg 47 is pivotally mounted on the assembling member 46. The two rear legs 48, 49 are pivotally mounted on the front leg 47. The front leg 47 and the two rear legs 48, 49 are collapsed with the rear legs 48, 49 joined to the front leg 47 to form a ground spike at a bottom portion of the foldable tripod 42 to be inserted into the ground.

With reference to FIGS. 2, 5 and 6, when the outdoor projector light is operated, an electric cable 50 penetrates through the cable hole 16 to enter the enclosure 10 and is connected to the power board 31. The electric cable 50 may be fastened on the cable connection seat 13. Power is supplied to the power board 31 of the rotation device 30 through the electric cable 50. The power board 31 converts AC (Alternating Current) power into DC (Direct Current) power and supplied the DC power to the projection device 20 and the motor 32 of the rotation device 30. After the projection device 20 receives the DC power, the primary lamp 221 of the primary lighting unit 22 and the secondary lamps 232 of the secondary lighting unit 23 emit light. Light emitted from the primary lamp 221 sequentially passes through the first primary plano-convex lens 224 and the second primary plano-convex lens 225 to project background patterns of the primary film 222, and further passes through the two bi-convex lenses 227 of the lens assembly 223 to project the background patterns of the primary film 222 on an object to form a static background image.

After the motor 32 of the rotation device 30 receives the DC power, the motor 32 rotates the spindle 33, the driving gear 34 is rotated to drive the driven gear 361 to rotate, the lens-mounting disc 37 on the front portion of the rotation base 36 is also rotated with the rotation base 36, and the multiple bi-convex lenses 38 are also rotated. Light emitted from the multiple secondary lamps 232 sequentially passes through the respective secondary bi-convex lenses 236 and the respective rotating bi-convex lenses 38, such that the even number of foreground patterns, six foreground patterns in the present embodiment, are projected on the static background patterns. As the number of the multiple bi-convex lenses 38 is even multiples of the number of the multiple secondary lamps 232, the foreground patterns of the secondary film 237 are projected with shapes similar to an umbrella gradually changing between a diverging position with the umbrella open and a converging position with the umbrella closed, such that the even number of umbrella-shaped foreground patterns exhibit a fluttering viewing effect changing between the open and closed states on the clear background patterns. The fluttering patterns also give rise to an entertaining effect with variations of dynamic pattern movement. Besides, the fluttering patterns are projected in an orderly fashion instead of a random fashion for assurance of viewing comfort. Also because the rotation base 36 abuts against the gear-pressing plate 35, the gear-pressing plate 35 can prevent the rotation base 36 from being vibrated when the rotation base 36 is operated. Thus, the lens-mounting disc 37 of the rotation base 36 can be rotated in a more stable way.

With reference to FIG. 8, the foldable tripod 42 of the support device 40 can be unfolded and directly placed on the ground or stage for operation. With reference to FIG. 9, the front leg 47 and the two rear legs 48, 49 are folded together as the ground spike to be inserted into the ground for the outdoor projector light to be mounted in an outdoor environment.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An outdoor projector light projecting foldable umbrella patterns with a fluttering effect, comprising:

an enclosure having:

a body having:

a chamber defined inside the body;

an opening formed through a front portion of the body and communicating with the chamber; and a cable hole formed through a rear portion of the body and communicating with the chamber;

a lid mounted on the body to cover the opening; and a cable connection seat mounted in the body, located inside the chamber, and being adjacent to the cable hole;

a projection device mounted inside the chamber of the enclosure and having:

a support frame mounted on an inner wall of the enclosure and located inside the chamber;

a primary lighting unit mounted in the support frame and having:

a primary lamp centrally mounted in the support frame;

a primary film mounted on the support frame, located in front of the primary lamp, and having multiple background patterns; and a lens assembly mounted in the support frame and located in front of the primary film; and a secondary lighting unit mounted on the support frame, located around the primary lighting unit, and having:

a secondary light board circumferentially mounted on the support frame; and multiple secondary lamps mounted on the secondary light board and located around a center of a circle formed by the multiple secondary lamps, wherein the center of the circle is located at the primary lamp;

a rotation device located inside the chamber and having:

a power board mounted inside the enclosure and electrically connected to the projection device;

a motor mounted on the support frame, electrically connected to the power board, and having a spindle rotatably mounted therein;

a driving gear mounted on a free end of the spindle and rotated with the spindle;

a gear-pressing plate mounted on the support frame;

a rotation base rotatably mounted to the projection device, abutting against the gear-pressing plate, and having:

a driven gear formed around a periphery of the rotation base and engaging the driving gear; and a bushing rotatably mounted inside the support frame of the projection device and abutting against an inner wall of the rotation base;

a lens-mounting disc securely mounted on a front portion of the rotation base; and multiple bi-convex lenses mounted on and located around the lens-mounting disc, and spaced apart from each other, wherein the multiple bi-convex lenses are even multiples of the multiple secondary lamps of the projection device; and a support device mounted on a bottom portion of the enclosure.

2. The outdoor projector light as claimed in claim 1, wherein the primary lighting unit further has:

a first primary plano-convex lens mounted inside the support frame and located in front of the primary lamp with a planar side of the first primary plano-convex lens facing the primary lamp; and a second primary plano-convex lens mounted inside the support frame and located in front of the first primary plano-convex lens with a convex side of the second primary plano-convex lens facing the primary lamp.

3. The outdoor projector light as claimed in claim 2, wherein the lens assembly of the primary lighting unit has:

a lens seat mounted in the support frame; and two bi-convex lenses mounted on the lens seat and spaced apart by a fixed distance.

4. The outdoor projector light as claimed in claim 3, wherein the secondary lighting unit further has:

a lamp cup board mounted on the support frame and located in front of the secondary light board;

multiple lamp cups formed on the lamp cup board to correspond to the respective secondary lamps;

a lens board mounted on a front side of the lamp cup board;

multiple secondary bi-convex lenses mounted on the lens board to correspond to the respective lamp cups;

a secondary film mounted on the lens board to cover the multiple secondary bi-convex lenses and having an even number of foreground patterns; and a film-pressing plate mounted on the lamp cup board to position and hold the secondary film and the lens board between the film-pressing plate and the lamp cup board.

5. The outdoor projector light as claimed in claim 4, wherein the secondary lighting unit has six secondary lamps, and the rotation device has twelve bi-convex lenses.

6. The outdoor projector light as claimed in claim 3, wherein the secondary lighting unit has six secondary lamps, and the rotation device has twelve bi-convex lenses.

7. The outdoor projector light as claimed in claim 3, wherein the support device has:

a connection assembly having:

a connection seat mounted on the bottom portion of the enclosure;

a connection ring mounted around a periphery of the connection seat; and a ball socket mounted in the connection seat; and a foldable tripod having:

an assembling member connected with the ball socket;

a front leg pivotally mounted on the assembling member; and two rear legs pivotally mounted on the front leg, wherein the front leg and the two rear legs are collapsed with the rear legs joined to the front leg to form a ground spike at a bottom portion of the foldable tripod.

8. The outdoor projector light as claimed in claim 2, wherein the secondary lighting unit further has:

a lamp cup board mounted on the support frame and located in front of the secondary light board;

multiple lamp cups formed on the lamp cup board to correspond to the respective secondary lamps;

a lens board mounted on a front side of the lamp cup board;

multiple secondary bi-convex lenses mounted on the lens board to correspond to the respective lamp cups;

a secondary film mounted on the lens board to cover the multiple secondary bi-convex lenses and having an even number of foreground patterns; and a film-pressing plate mounted on the lamp cup board to position and hold the secondary film and the lens board between the film-pressing plate and the lamp cup board.

9. The outdoor projector light as claimed in claim 8, wherein the secondary lighting unit has six secondary lamps, and the rotation device has twelve bi-convex lenses.

10. The outdoor projector light as claimed in claim 2, wherein the secondary lighting unit has six secondary lamps, and the rotation device has twelve bi-convex lenses.

11. The outdoor projector light as claimed in claim 2, wherein the support device has:

a connection assembly having:

a connection seat mounted on the bottom portion of the enclosure;

a connection ring mounted around a periphery of the connection seat; and a ball socket mounted in the connection seat; and a foldable tripod having:

an assembling member connected with the ball socket;

a front leg pivotally mounted on the assembling member; and two rear legs pivotally mounted on the front leg, wherein the front leg and the two rear legs are collapsed with the rear legs joined to the front leg to form a ground spike at a bottom portion of the foldable tripod.

12. The outdoor projector light as claimed in claim 1, wherein the lens assembly of the primary lighting unit has:

a lens seat mounted in the support frame; and two bi-convex lenses mounted on the lens seat and spaced apart by a fixed distance.

13. The outdoor projector light as claimed in claim 12, wherein the secondary lighting unit further has:

a lamp cup board mounted on the support frame and located in front of the secondary light board;

multiple lamp cups formed on the lamp cup board to correspond to the respective secondary lamps;

a lens board mounted on a front side of the lamp cup board;

multiple secondary bi-convex lenses mounted on the lens board to correspond to the respective lamp cups;

a secondary film mounted on the lens board to cover the multiple secondary bi-convex lenses and having an even number of foreground patterns; and a film-pressing plate mounted on the lamp cup board to position and hold the secondary film and the lens board between the film-pressing plate and the lamp cup board.

14. The outdoor projector light as claimed in claim 13, wherein the secondary lighting unit has six secondary lamps, and the rotation device has twelve bi-convex lenses.

15. The outdoor projector light as claimed in claim 12, wherein the secondary lighting unit has six secondary lamps, and the rotation device has twelve bi-convex lenses.

16. The outdoor projector light as claimed in claim 12, wherein the support device has:

a connection assembly having:

a connection seat mounted on the bottom portion of the enclosure;

a connection ring mounted around a periphery of the connection seat; and a ball socket mounted in the connection seat; and a foldable tripod having:

an assembling member connected with the ball socket;

a front leg pivotally mounted on the assembling member; and two rear legs pivotally mounted on the front leg, wherein the front leg and the two rear legs are collapsed with the rear legs joined to the front leg to form a ground spike at a bottom portion of the foldable tripod.

17. The outdoor projector light as claimed in claim 1, wherein the secondary lighting unit further has:

a lamp cup board mounted on the support frame and located in front of the secondary light board;

multiple lamp cups formed on the lamp cup board to correspond to the respective secondary lamps;

a lens board mounted on a front side of the lamp cup board;

multiple secondary bi-convex lenses mounted on the lens board to correspond to the respective lamp cups;

a secondary film mounted on the lens board to cover the multiple secondary bi-convex lenses and having an even number of foreground patterns; and a film-pressing plate mounted on the lamp cup board to position and hold the secondary film and the lens board between the film-pressing plate and the lamp cup board.

18. The outdoor projector light as claimed in claim 17, wherein the secondary lighting unit has six secondary lamps, and the rotation device has twelve bi-convex lenses.

19. The outdoor projector light as claimed in claim 1, wherein the secondary lighting unit has six secondary lamps, and the rotation device has twelve bi-convex lenses.

20. The outdoor projector light as claimed in claim 1, wherein the support device has:

a connection assembly having:

a connection seat mounted on the bottom portion of the enclosure;

a connection ring mounted around a periphery of the connection seat; and a ball socket mounted in the connection seat; and a foldable tripod having:

an assembling member connected with the ball socket;

a front leg pivotally mounted on the assembling member; and two rear legs pivotally mounted on the front leg, wherein the front leg and the two rear legs are collapsed with the rear legs joined to the front leg to form a ground spike at a bottom portion of the foldable tripod.

* * * * *